US005197996A

United States Patent [19]

Reid et al.

[11] Patent Number: 5,197,996

[45] Date of Patent: Mar. 30, 1993

[54] METHODS AND COMPOSITIONS FOR COLOR STABILIZED DISTILLATE FUEL OILS

[75] Inventors: Dwight K. Reid, Houston; Spencer S. Awbrey, Spring, both of Tex.

[73] Assignee: Betz Laboratories, Inc., Trevose, Pa.

[21] Appl. No.: 904,228

[22] Filed: Jun. 25, 1992

[51] Int. Cl.[5] ..... C10L 1/22; C10L 1/30

[52] U.S. Cl. ..... 44/317; 44/320

[58] Field of Search ..... 44/317, 320

[56] References Cited

U.S. PATENT DOCUMENTS

| | | | |
|---|---|---|---|
| 2,305,674 | 12/1942 | Chenicek | 44/72 |
| 2,329,251 | 9/1943 | Chenicek | 44/66 |
| 2,672,408 | 3/1954 | Bonner | 44/72 |
| 2,945,749 | 7/1960 | Andress, Jr. | 44/72 |
| 3,035,904 | 5/1962 | Brown | 44/317 |
| 3,598,855 | 8/1971 | Cyba | 44/317 |
| 3,692,680 | 9/1972 | Cyba | 44/317 |
| 4,509,952 | 4/1985 | Braxton, Jr. | 44/57 |
| 4,648,885 | 3/1987 | Reid | 44/57 |
| 4,818,251 | 4/1989 | Easton et al. | 44/320 |
| 4,822,378 | 4/1989 | Reid | 44/53 |
| 4,867,754 | 9/1989 | Reid | 44/72 |

*Primary Examiner*—Jacqueline Howard

*Attorney, Agent, or Firm*—Alexander D. Ricci; Philip H. Von Neida

[57] ABSTRACT

This invention relates to methods and compositions for color stabilized distillate fuel oils which comprise adding an effective stabilizing amount of a combination of (a) a boron hydride-amine compound and (b) an organic silicon compound.

27 Claims, No Drawings

METHODS AND COMPOSITIONS FOR COLOR STABILIZED DISTILLATE FUEL OILS

FIELD OF THE INVENTION

This invention relates to methods and compositions for color stabilized distillate fuel oils which comprise a stabilizing amount of a boron hydride-amine compound and an organic silicon compound.

BACKGROUND OF THE INVENTION

Various middle distillate fuel oils tend, with time, to deteriorate. Normally, distillate fuel oils are stable during standing. However, some distillate fuel oils that contain abnormally high levels of organic acid and sulfur containing species can be quite unstable and may deteriorate. This deterioration usually results in the formation of sediment, sludge, or gum and objectionable color deterioration during transportation and storage. This fuel oil deterioration is caused, in part, by the presence of oxygen in the storage tank containing the fuel oil. Resulting oxidation of the fuel oil manifests itself in the appearance of darker colors, gum and the like. Sediment formation may cause clogging of fuel system equipment such as filters, screens, nozzles, burners and other associated equipment. This problem may be further aggravated when cracked material is blended with distillate fuels. Discoloration of distillate fuel oils is objectionable for various reasons, including customers' preference for light colored fuel oils because discolorization may indicate that deterioration has occurred.

SUMMARY OF THE INVENTION

The present invention pertains to methods for color stabilizing distillate fuel oils which comprises adding to the distillate fuel oil an effective stabilizing amount of a (a) boron hydride-amine compound and (b) an organic silicon compound. The present invention is also directed towards color stabilized distillate fuel oil compositions comprising distillate fuel oil and a stabilizing amount of a boron hydride-amine compound and an organic silicon compound. More particularly, the methods and compositions of this invention relate to inhibiting particulate formation and color deterioration of distillate fuel oils.

DESCRIPTION OF THE RELATED ART

U.S. Pat. No. 2,305,674, Chenicek, teaches employing a hydroxy-alkyl-substituted alkylene diamine compound with a gasoline gum inhibitor to prevent the deterioration of gasoline over long periods of time. Chenicek further teaches in U.S. Pat. No. 2,329,251 the use of an alkylene polyamine salt of an organic acid along with a gum inhibitor to inhibit gum formation in gasolines.

U.S. Pat. No. 2,672,408, Bonner, teaches using tertiary amine compounds to inhibit discoloration of blends of cracked fuel oil and straight run fuel oil. U.S. Pat. No. 2,445,749, Andress, teaches stabilization of fuel oils using tertiary alkyl monoamine compounds containing from 4 to 24 carbon atoms. U.S. Pat. No. 4,509,952, Braxton, Jr., teaches using alkyldimethylamine to stabilize distillate fuel oils.

Reid, U.S. Pat. No. 4,648,885 teaches a distillate fuel oil stabilizing combination in which one of the ingredients is triethylenetetramine. Reid also teaches in U.S. Pat. No. 4,822,378 the use of a hydroxylamine in combination with a tertiary amine to stabilize distillate fuel oils. Reid also teaches in U.S. Pat. No. 4,867,754 that distillate fuel oils can be stabilized by a combination of a phosphite compound and a tertiary amine compound.

DETAILED DESCRIPTION OF THE INVENTION

The present invention relates to methods and compositions for color stabilizing distillate fuel oils comprising adding to said fuel oil a stabilizing amount of (a) a boron hydride-amine compound and (b) an organic silicon compound.

The boron hydride-amine compounds of this invention are typified by borane-amine compounds and borohydride-amine compounds. Specific examples of borane-amine compounds include borane dimethylamine complex, borane trimethylamine complex, borane-tert-butylamine complex, borane morpholine complex, and borane-N-ethylmorpholine. Specific examples of borohydride-amine compounds include tetramethylammonium borohydride and tetrabutylammonium borohydride. These compounds are commercially available from the Aldrich Chemical Company.

The boron hydride-amine compounds generally have the formula $$BH_xNR_x$$

wherein x is either 3 or 4, R is an alkyl group or $NR_x$ is morpholine or N-ethyl-morpholine. Preferred boron hydride-amine compounds include boranedimethylamine complex, boranetrimethylamine complex, borane-tert-butylamine complex, borane morpholine complex, and borane-N-ethylmorpholine complex.

The organic silicon compounds of this composition generally have the formula $$[(R'_x)SiO]_y(R'')_z$$

wherein x is 1 to 3, y is 1 or 2 and z is 0 or 1, and R' is an alkyl group from 1 to 6 carbons, R'' is an alkyl group from 1 to 6 carbons, or an alkylene group from 1 to 6 carbons or $CH_3C(=NSi(CH_3)_3)$. Preferred compounds include dimethylsiloxane, 1,2-bis(trimethylsilyloxy)ethane, and N,O-bis(trimethylsilyl)acetamide.

The amount or concentration of the compounds of this invention can vary depending on, among other things, the tendency of the distillate fuel oil to undergo deterioration or, more specifically, to form particulate matter and or discolor.

The weight ratio of (a):(b) is from about 10:1 to about 1:10. Preferably, the weight ratio is about 3:1 based on the total combined weight of these two components. The treatment compounds should be added to the distillate fuel oil in sufficient quantity to ensure that there is enough combination of (a) and (b) present to inhibit fuel oil deterioration. Generally, the total amount of (a) and (b) is from about 1 part to about 500 parts per million parts distillate fuel oil. It is preferred that the total dosage ranges from about 5 parts per million to about 100 parts per million parts distillate fuel oil.

The compounds of the present invention can be added to the distillate fuel oil by any conventional method. They may be added either as a concentrate or as a solution using a suitable carrier solvent which is compatible with the treatment components and the distillate fuel oils. The compounds may be added individually or in combination and can be added at ambient temperature and pressure to stabilize the distillate fuel oil during storage. The mixture is preferably added to the distillate fuel oil prior to any appreciable deterioration of the fuel oil as this will either eliminate deterioration or effectively reduce the formation of particulate matter and/or color deterioration. However, the mixture is also effective even after some deterioration has occurred.

The present invention also pertains to a stabilized distillate fuel oil composition comprising a major proportion of distillate fuel oil, such as straight run diesel fuel, and a minor portion of an effective stabilizing amount of a combination of (a) boron hydride-amine compound and (b) an organic silicon compound. The total amount of combined treatment is present at a range of about 1 part per million to about 500 parts per million parts distillate fuel. Preferably, the combined treatment of (a) and (b) ranges from about 5 parts per million to about 100 parts per million parts distillate fuel oil.

The distillate fuel oils of this invention are those fuels produced by distillation of fuel oils, such as straight run diesel fuel. More particularly, the distillate fuel oils of this invention are those fuel oils having hydrocarbon components distilling from about 300° F. to about 700° F., such as kerosene, jet fuel, and diesel fuel. Preferably, the distillate fuel oil is straight run diesel fuel.

The processes and compositions of the instant invention effectively stabilize the distillate fuel oils, particularly during storage. The term "stabilize" as used herein means that particulate formation in the distillate fuel oil and color deterioration of the distillate fuel oil are inhibited. The term "particulate formation" is meant to include the formation of soluble solids, sediment and gum.

In order to more clearly illustrate this invention, the data set forth below was developed. The following examples are included as being illustrations of the invention and should not be construed as limiting the scope thereof.

EXAMPLES

The test methods used to determine the effectiveness of the compounds of the instant invention were the 175° F. dark storage test and the 110° F. dark storage test. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from more accelerated conditions.

Four-ounce glass bottles were filled with 100 mls of the distillate fuel oil. The samples were then spiked with the appropriate treatment and contaminant where necessary. The glass bottles were capped but not tightly sealed to allow for the samples to be exposed to air during the test. The bottles were then transferred to an oil bath at either 175° F.±2° F. and 110° F.±2° F. during the duration of the test. The bath oil level covered at least three-fourths of the sample. The test was allowed to run for the time periods indicated.

The samples are then allowed to cool to room temperature. Each sample is then poured into a separatory funnel and filtered (dispersed) through a tared Gooch crucible containing a filter paper. The ASTM-D-1500 procedure was used to determine the color of the filtrant. The sample container was washed with rinsings (about 50 ml) of a heptane/acetone solvent (50/50). The separatory funnel and filter washing was also worked through the crucible. The crucible was dried n an oven (100° C.) in most instances for one hour, cooled in a dessicator and the precipitate was weighed. Sediment amounts and color numbers are presented in the following tables.

TABLE I

Southwestern Refinery Blend
30% catalytic cracked light gas oil (CCLGO) and
70% straight run light gas oil (SRLGO)
Darkstorage Test at 175° F. for 7 days

| Treatment Agent (ppm) | Sediment (mg/100 ml) | Color (ASTM 1500) |
|---|---|---|
| A | 0.9 | 1.8 |
| B (80/20) | 0.5 | 1.2 |
| C (80/20) | 4.2 | 1.2 |
| D (80/20) | 1.1 | 1.5 |
| E (80/20) | 0.7 | 1.8 |

Initial color = 0.5
A = Control
B = Boranedimethylamine complex (BDM) + 1,2-bis(trimethylsilyloxy)ethane(TMSE)
C = BDM + N,O-bis(trimethylsilyl)acetamide(TMSA)
D = Boranemorpholine complex (BMC) + TMSA
E = BMC + TMSE These results indicate that the claimed compositions of the instant invention inhibit deterioration by way of sediment formation and discoloration. Further testing of this fuel oil yielded the results presented in Table II.

TABLE II

Southwestern Refinery Blend
30% CCLGO/70% SRLGO
Darkstorage Test at 175° F. for 7 days

| Treatment Agent (ppm) | Sediment (mg/100 ml) | Color (ASTM 1500) |
|---|---|---|
| A (Avg.) | 0.9 | 2.1 |
| B | 3.6 | 1.4 |
| C | 3.2 | 1.5 |
| D | 6.8 | 1.3 |
| E | 7.0 | 1.3 |

Initial color = 0.7
A = Control
B = BDM (75 ppm) + TMSE (10 ppm)
C = BMC (100 ppm) + TMSE (10 ppm)
D = BDM (150 ppm) + TMSE (25 ppm)
E = BDM (150 ppm) + Dimethylsiloxane (DMS) (25 ppm)

TABLE III

Southwestern Refinery Blend
40% CCLGO/60% SRLGO
Darkstorage Test at 175° F. for 7 days

| Treatment Agent (ppm) | Sediment (mg/100 ml) | Color (ASTM 1500) |
|---|---|---|
| Boranetrimethylamine (100) | 3.2 | 1.5 |
| BMC (100) | 2.7 | 1.9 |
| BDM (100) | 4.6 | 1.5 |
| N-ethylboranemorpholine complex (EBMC) (100) | 1.7 | 2.8 |
| TMSE (100) | 1.0 | 2.8 |
| TMSA (100) | 1.0 | 2.4 |
| EBMC (50) + TMSA (50) | 2.8 | 1.3 |
| BDM (50) + TMSA (50) | 1.0 | 1.8 |
| Control | 1.1 | 2.7 |
| Control | 1.0 | 2.5 |

Glasfiberfilter 0.3 micron used to determine sediment

These results are again indicative of the efficacy of the combination treatment at inhibiting deterioration in distillate fuel oils.

TABLE IV

Southwestern Refinery Blend
30% CCLGO/70% SRLGO
Darkstorage Test at 175° F. for 7 days

| Treatment Agent (ppm) | Sediment (mg/100 ml) | Color (ASTM 1500) |
|---|---|---|
| BDM (100) | 0.3 | 3.0 |
| BMC ((100) | 0.2 | 2.6 |
| TMSE (100) | 1.8 | 2.6 |
| DMS (100) | 1.6 | 2.8 |
| BDM (75) + TMSE (25) | 0.4 | 2.6 |
| BDM (75) + DMS (25) | 0.2 | 3.2 |
| BMC (75) + TMSE (25) | 0.2 | 2.6 |
| BMC (75) + DMS (25) | 0.5 | 2.6 |
| BDM (50) + TMSE (50) | 0.1 | 2.3 |
| BDM (50) + DMS (50) | 0.4 | 2.9 |
| BMC (50) + TMSE (50) | 0.9 | 2.6 |
| BMC (50) + DMS (50) | 0.9 | 2.5 |
| Control | 1.9 | 3.0 |

These results again indicate the effectiveness at inhibiting degradation of distillate fuel oils by the combination treatment. Testing was also performed utilizing the borohydride compounds with the organic silicon compounds. These results appear in Table V.

TABLE V

Southwestern Refinery Blend
21.5% Light Crude Oil, 33.5% Diesel, 25% TK236, 20% Kerosene
Darkstorage Test at 175° F. for 7 days

| Treatment Agent (ppm) | Sediment (mg/100 ml) | Color (ASTM 1500) |
|---|---|---|
| A | 0.4 | 2.0 |
| B | 0.3 | 2.0 |
| C (150) | 1.4 | 2.4 |
| D (75/100) | 1.4 | 2.0 |

A = Control
B = Control
C = Tetramethylammoniumborohydride (TMAB)
D = TMAB + TMSE These results show the efficacy of the borohydrides in combination with the organic silicon compounds at inhibiting distillate fuel oil degradation. Further degradation testing is presented in Table VI.

TABLE VI

Southwestern Refinery Blend
40% CCLGO/60% SRLGO
Darkstorage Test at 175° F. for 7 days

| Treatment Agent (ppm) | Sediment (mg/100 ml) | Color (ASTM 1500) |
|---|---|---|
| A | 1.1 | 2.7 |
| B | 1.0 | 2.5 |
| C | 1.0 | 1.8 |
| D | 1.1 | 2.0 |

Initial Color = 0.7
A = Control
B = Control
C = Tetramethylammoniumborohydride (50) + TMSE (50)
D = Tetramethylammoniumborohydride (50) + TMSA (50)

TABLE VII

Southwestern Refinery Blend
40% CCLGO/60% SRLGO
Darkstorage Test at 110° F. for 90 days

| Treatment Agent (ppm) | Sediment (mg/100 ml) | Color (ASTM 1500) |
|---|---|---|
| TMAB (100) | 13.7 | 3.3 |
| TMSE (100) | 8.9 | 2.9 |
| TMSA (100) | 5.1 | 3.0 |
| TMAB (50) + TMSE (50) | 1.3 | 3.0 |
| TMAB (50) + TMSA (50) | 1.1 | 3.0 |
| Control | 1.6 | 3.3 |

TABLE VII-continued

Southwestern Refinery Blend
40% CCLGO/60% SRLGO
Darkstorage Test at 110° F. for 90 days

| Treatment Agent (ppm) | Sediment (mg/100 ml) | Color (ASTM 1500) |
|---|---|---|
| Control | 1.5 | 3.3 |

These results further indicate the efficacy of the borohydrides in combination with the organic silicon compounds to both inhibit particulate formation and inhibit color degradation, thus controlling the degradation of distillate fuel oils.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A method for color stabilizing distillate fuel oil comprising adding to said fuel oil an effective color stabilizing amount of a combination of (a) a boron hydride-amine compound and (b) an organic silicon compound wherein the weight ration of (a):(b) is from about 10:1 to about 1:10.

2. The method as claimed in claim 1 wherein said boron hydride-amine compound has the formula $$BH_xNR_x$$

wherein x is either 3 or 4, R is an alkyl group or $NR_x$ is morpholine or N-ethyl-morpholine.

3. The method as claimed in claim 2 wherein said boron hydride-amine compound is boranedimethylamine complex.

4. The method as claimed in claim 2 wherein said boron hydride-amine compound is boranemorpholine complex.

5. The method as claimed in claim 2 wherein said boron hydride-amine compound is tetrabutylammonium borohydride.

6. The method as claimed in claim 2 wherein said boron hydride-amine compound is tetramethylammonium borohydride.

7. The method as claimed in claim 1 wherein said organic silicon compound has the formula $$[(R'_x)SiO]_y(R'')_z$$

wherein x is 1 to 3, y is 1 or 2 and z is 0 or 1, and R' is an alkyl group from 1 to 6 carbons, R'' is an alkyl group from 1 to 6 carbons, or an alkylene group from 1 to 6 carbons or $CH_3C(=NSi(CH_3)_3)$.

8. The method as claimed in claim 1 wherein said organic silicon compound is dimethylsiloxane.

9. The method as claimed in claim 1 wherein said organic silicon compound is 1,2-bis(trimethylsiloxy)ethane.

10. The method as claimed in claim 1 wherein said organic silicon compound is N,O-bis(trimethylsilyl-)acetamide.

11. The method as claimed in claim 1 wherein said boron hydride-amine compound and said organic silicon compound are added to said fuel oil prior to color deterioration of said fuel oil.

12. The method as claimed in claim 1 wherein said distillate fuel oil is a blended diesel fuel.

13. The method as claimed in claim 1 wherein said mixture is added to said fuel oil in an amount from about 1 part to about 500 parts per million parts of said fuel oil.

14. The method as claimed in claim 1 wherein the weight ratio of (a):(b) is from about 3:1.

15. A color stabilized distillate fuel oil composition comprising distillate fuel oil and an effective stabilizing amount of a mixture of (a) a boron hydride-amine compound and (b) an organic silicon compound wherein the weight ratio of (a):(b) is from about 10:1 to about 1:10.

16. The composition as claimed in claim 15 wherein said boron hydride-amine compound has the formula $$BH_xNR_x$$

wherein x is either 3 or 4, R is an alkyl group or $NR_x$ is morpholine or N-ethyl-morpholine.

17. The composition as claimed in claim 15 wherein said borane-amine compound is boranedimethylamine complex.

18. The composition as claimed in claim 15 wherein said borane-amine compound is boranemorpholine complex.

19. The composition as claimed in claim 15 wherein said borohydride-amine compound is tetramethylammonium borohydride.

20. The composition as claimed in claim 15 wherein said borohydride-amine compound is tetrabutylammonium borohydride.

21. The composition as claimed in claim 15 wherein said organic silicon compound has the formula $$[(R'_x)SiO]_y(R'')_z$$

wherein x is 1 to 3, y is 1 or 2 and z is 0 or 1, and R′ is an alkyl group from 1 to 6 carbons, R″ is an alkyl group from 1 to 6 carbons, or an alkylene group from 1 to 6 carbons or $CH_3C(=NSi(CH_3)_3)$.

22. The composition as claimed in claim 15 wherein said organic silicon compound is dimethylsiloxane.

23. The composition as claimed in claim 15 wherein said organic silicon compound is 1,2-bis(trimethylsiloxy)ethane.

24. The composition as claimed in claim 15 wherein said organic silicon compound is N,O-bis(trimethylsilyl-)acetamide.

25. The composition as claimed in claim 15 wherein the total amount of (a) and (b) is from about 1 part to about 500 parts per million parts of said fuel oil.

26. The composition as claimed in claim 15 wherein the weight ratio of (a):(b) is from about 3:1.

27. The composition as claimed in claim 15 wherein said distillate fuel oil is a blended diesel fuel.

* * * * *